United States Patent [19]

Salvino

[11] 4,211,374

[45] Jul. 8, 1980

[54] PORTABLE DEVICE FOR SUPPORTING A ROLL OF ALUMINUM SHEETING FOR DISPENSING

[76] Inventor: Lawrence P. Salvino, 285 Milton Rd., Waucanda, Ill. 60084

[21] Appl. No.: 16,450

[22] Filed: Mar. 1, 1979

[51] Int. Cl.[2] ..... B65H 75/02

[52] U.S. Cl. ..... 242/55; 242/68.7

[58] Field of Search ..... 242/55, 55.2, 68.7, 242/76, 78.7, 129; 206/386

[56] References Cited

U.S. PATENT DOCUMENTS

| | | | |
|---|---|---|---|
| 2,220,230 | 11/1940 | Gilbert | 242/68.7 |
| 4,094,473 | 6/1978 | Salvino | 242/68.7 X |

FOREIGN PATENT DOCUMENTS

| | | | |
|---|---|---|---|
| 935676 | 6/1948 | France | 242/68.7 |
| 636718 | 5/1950 | United Kingdom | 242/68.7 |

*Primary Examiner*—John M. Jillions

*Attorney, Agent, or Firm*—Rummler & Snow

[57] ABSTRACT

A portable, lightweight device for supporting a roll of aluminum sheeting having a stationary lower arcuate-shaped, inverted U-shaped channel member supported on a stand, and an upper arcuate-shaped shiftable channel member having one end pivotally secured to one end of the lower member, adjustable means for retaining the upper member on a roll of aluminum sheeting to retain it between the channel members and adjustable means on opposite sides of said roll to retain it within the members.

4 Claims, 12 Drawing Figures

PORTABLE DEVICE FOR SUPPORTING A ROLL OF ALUMINUM SHEETING FOR DISPENSING

BACKGROUND OF THE INVENTION

The field of invention is a cradle for supporting and maintaining a roll of aluminum sheeting for use in making on-site gutters whereby the aluminum will be kept clean.

This invention is an improvement of the invention shown and described in my U.S. Pat. No. 4,094,473 issued June 13, 1978.

SUMMARY OF THE INVENTION

A lightweight device for retaining a roll of sheeting within the device having a pair of stationary, spaced, convex shaped channels and a pair of concave, spaced channels above and in alignment with the convex channels, the concave channels being pivotally secured to the convex channels at one end, a base to which the convex channels are anchored, and post means secured between the convex channels and extending upwardly, and means on said post means to anchor said concave channels to prevent unwinding of a roll of sheeting in said device.

DETAILED DESCRIPTION OF THE DRAWINGS

Figure 1:
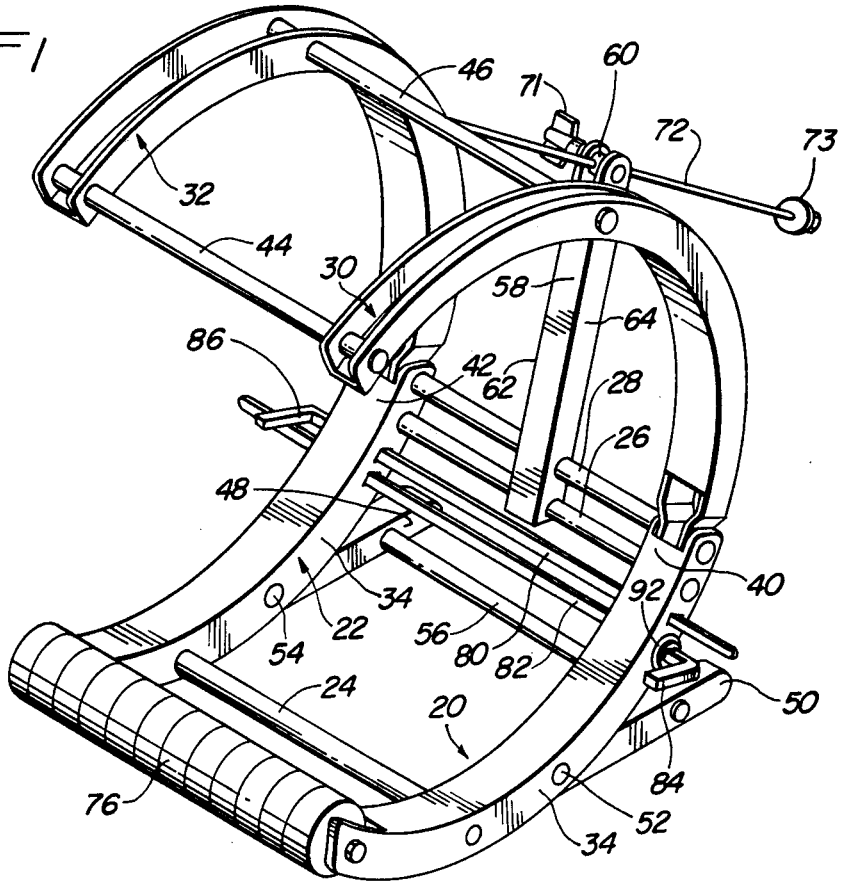
FIG. 1 is a perspective view of the device of the invention.

Substantially every part described hereinbelow is constructed of aluminum U-shaped channels and thus the entire unit is extremely lightweight.

The device shown in FIGS. 1-6 comprises a pair of spaced, stationary, concave, inverted U-shaped channels 20, 22 held in spaced position by rods 24, 26, 28 secured in fixed position thereto, and a pair of spaced, convex U-shaped channels 30, 32 pivotally secured one to each of said concave channel arms. The lower rear ends 33, 35 of the convex channels are offset to seat between the upper rear end of the concave channels and are pivotally anchored to the side legs 34, 36 by rod 28. The upper rear end of the connecting legs 40, 42 of the concave channels are cut away to provide full pivoting of the convex channels. The convex channels are held in spaced relationship by rods 44, 46.

A frame comprising channels 48, 50 is anchored at one end between the side legs 34, 36 of the concave channels 20, 22, respectively, by pins 52, 54 and held in spaced relationship by rod 56 which is secured to the respective side legs 34, 36.

An upwardly and rearwardly extending bracket 58 is secured at its lower end to rods 26, 28 medially between the convex channels 30, 32. The upper end of the bracket is provided with a rotary solid rod 60 positioned in the side legs 62. 64. The rod 60 is provided with an enlarged opening 66 and a threaded transverse opening 68 communicating with the opening 66. An adjusting screw 70 is positioned in said threaded opening and is provided with a hand knob 71.

An elongated rod 72 is positioned in said opening 66 with one end anchored to rod 46. The opposite end is provided with a hand knob 73.

By loosening screw 68, the rod may readily shift the convex channels 30, 32 in variable positions relative to the stationary concave channels 20, 22 and when the position desired is achieved, i.e., on the roll of sheet aluminum, the screw 70 is tightened.

In order to readily withdraw the aluminum sheeting from the device, a roller 76 is positioned between the free ends of concave channels 20, 22 and positioned on rod 78 which is anchored between the side walls 34, 36 of the channels 20, 22.

A pair of square laterally-adjusting rods 80, 82 are positioned between and through the side walls 32, 34 of the concave channels 20, 22 and each rod 80, 82 has one end bent at right angles as at 84, 86 and held in any variable lateral position by thumb screws 88, 90 to support any width of the roll of aluminum sheeting. The rods 80, 82 slide in sleeves 92, 94, respectively, positioned in the side walls 32, 34.

In operation, the knob 71 is turned to release the rod 72 and the handle 73 pulls the convex channels upwardly and rearwardly about its pivot on the distal ends of rod 28 and locked by the knob 71. Then the adjusting bars 80, 82 are shifted laterally outwardly. Now a roll of aluminum sheeting 96 is placed on the concave channels 20, 22 and the convex channels lowered to be in contact with roll 96 and the thumb screw 71 tightened. Now the adjusting arms or rods 80, 82 are each moved so that the ends 84, 86 are in loose contact with the roll 96 to center the roll 96 on the channels 20, 22, 30, 32, and the rods anchored in place by tightening of the knobs 88, 90.

Figure 2:
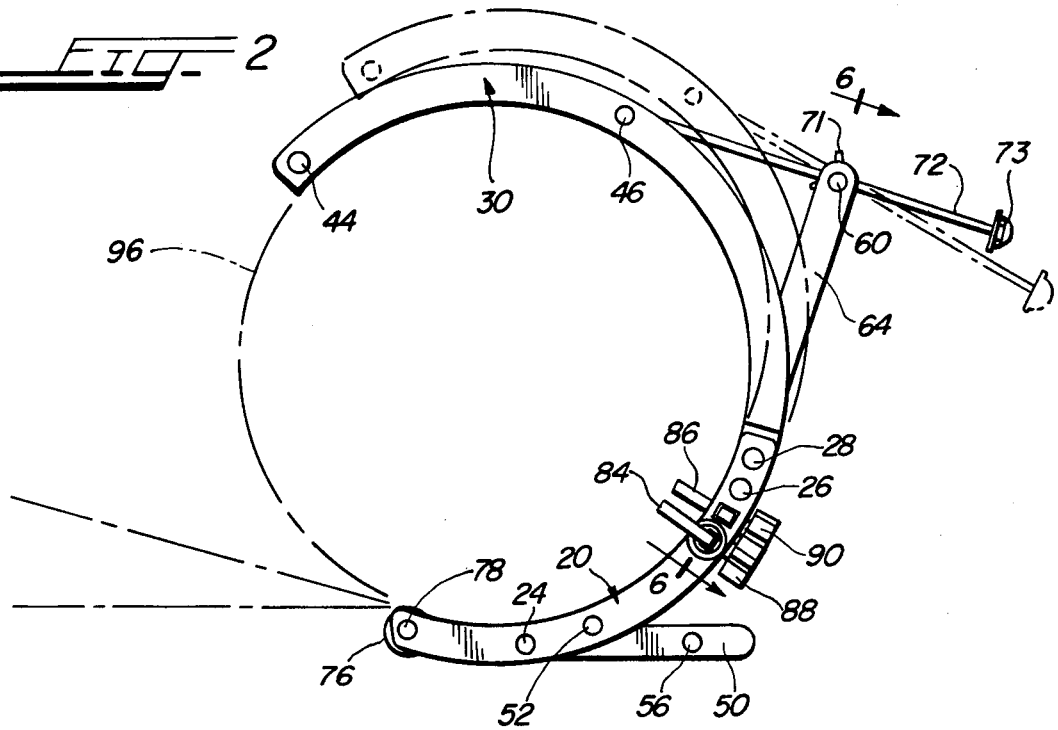
FIG. 2 is a side elevational view thereof.
Figure 3:
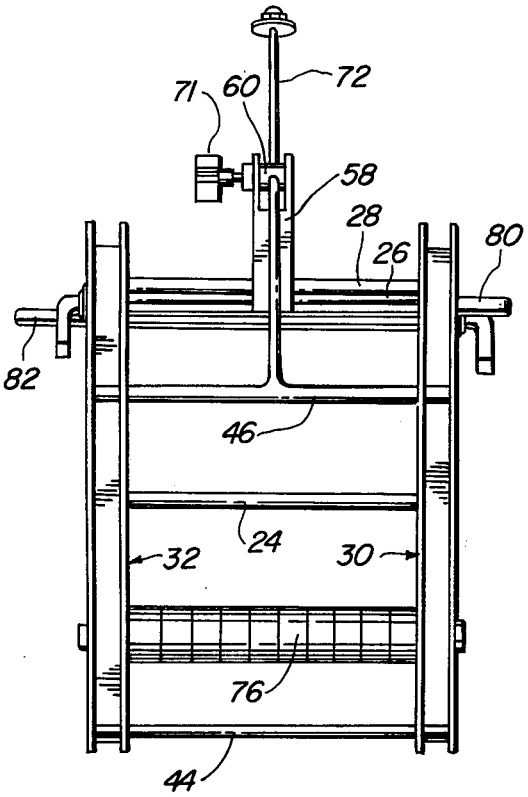
FIG. 3 is a rear elevational view thereof.
Figure 4:
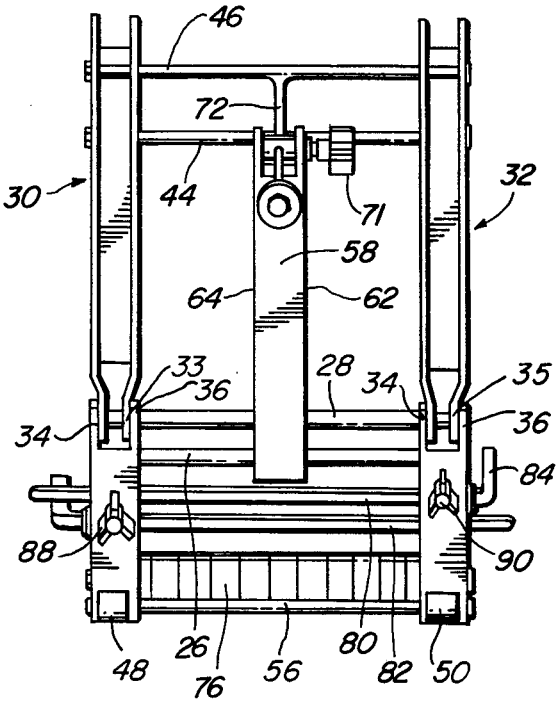
FIG. 4 is a top elevational view thereof.
Figure 5:
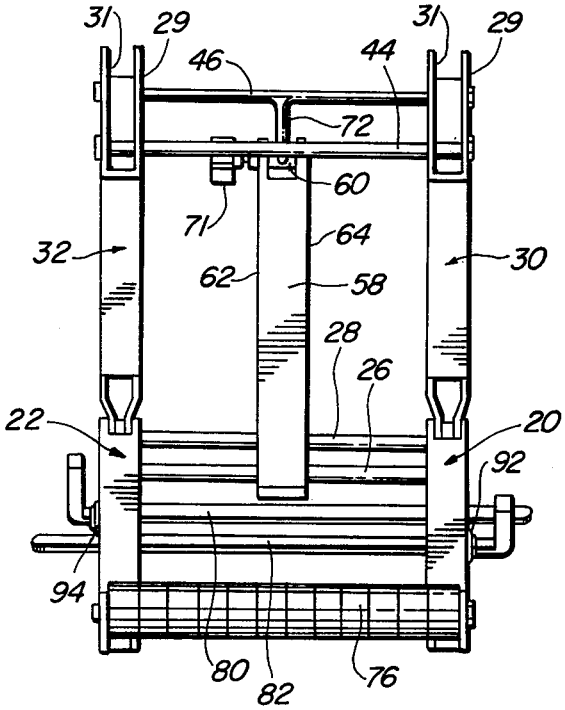
FIG. 5 is a front elevational view thereof.
Figure 6:
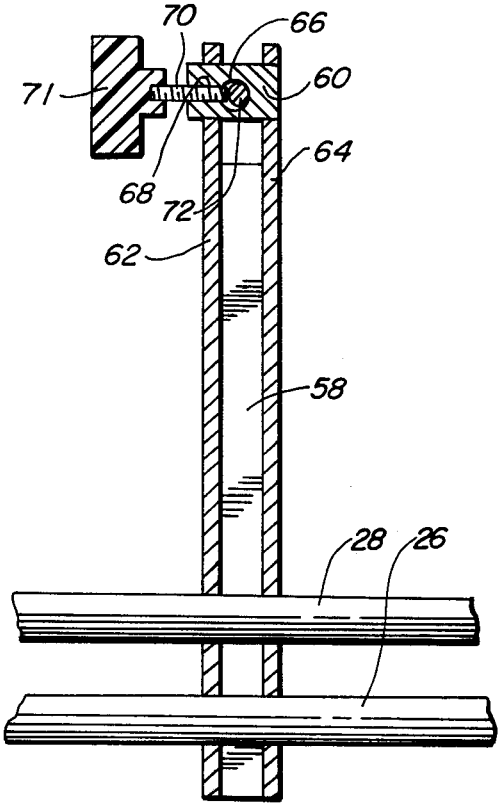
FIG. 6 is a cross-sectional view taken on lines 6—6 of FIG. 2.
Figure 7:
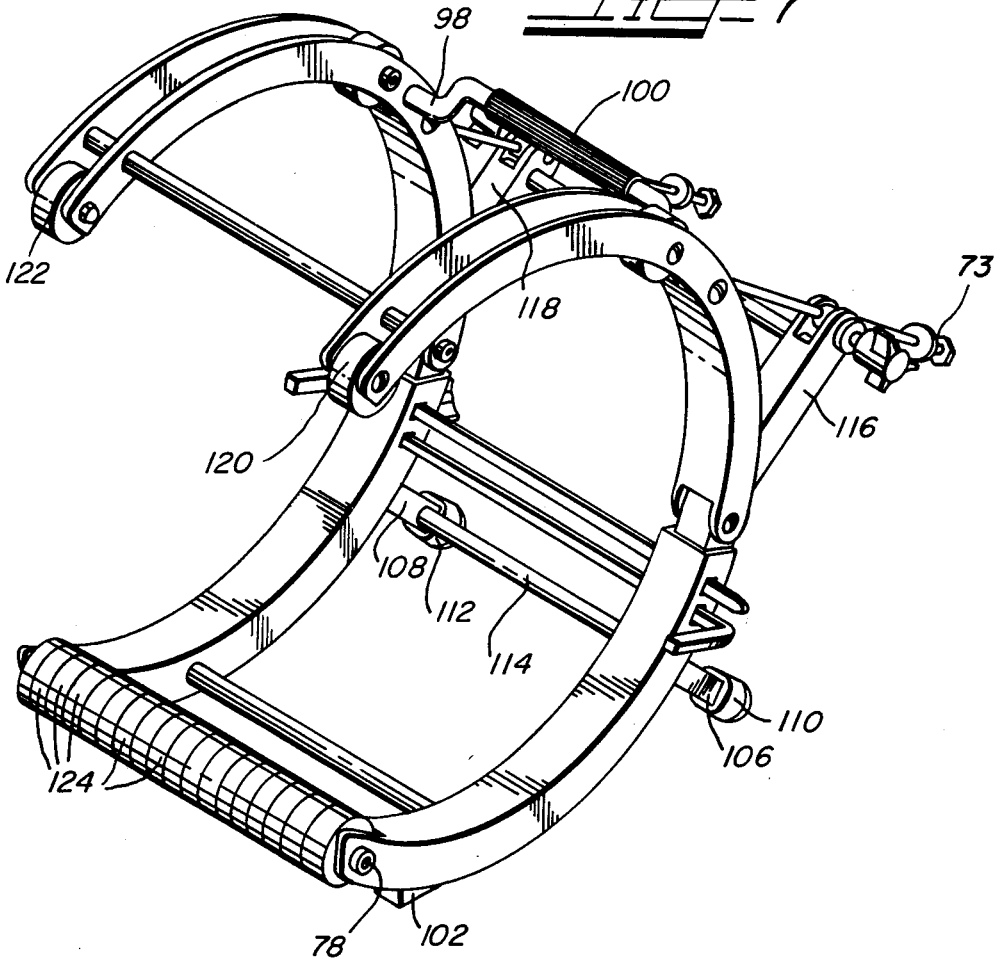
FIG. 7 is a perspective view of a modified form of the invention.
Figure 8:
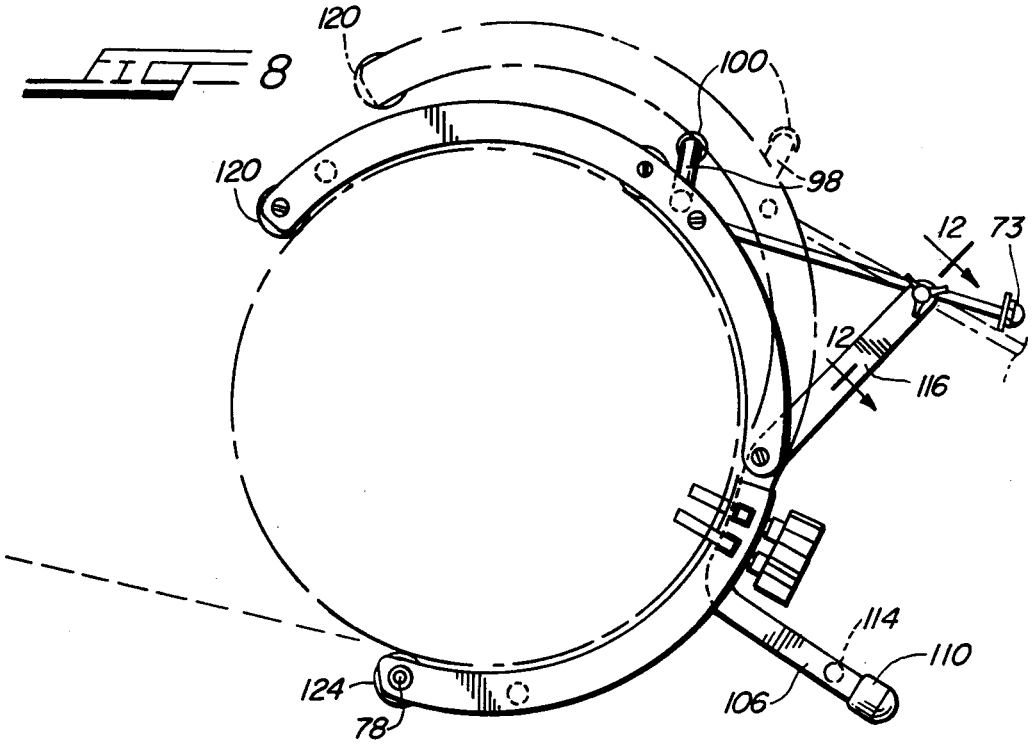
FIG. 8 is a side elevational view of FIG. 7.
Figure 9:
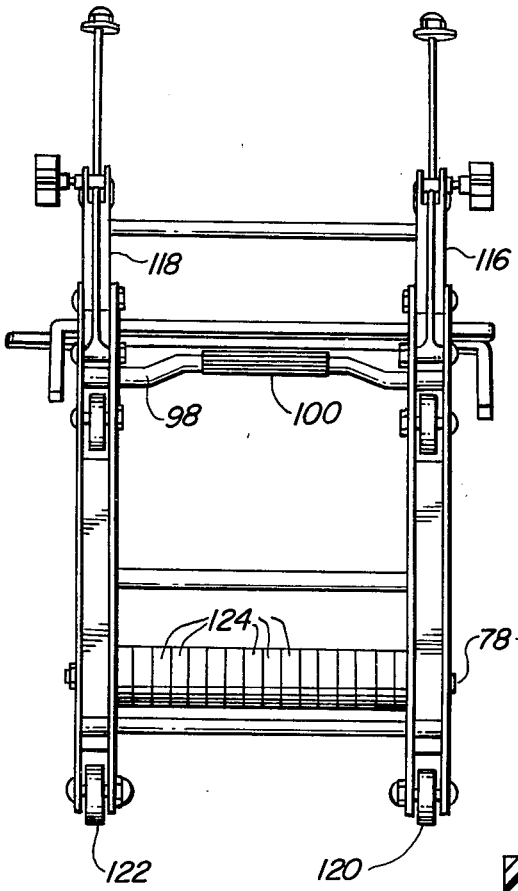
FIG. 9 is a top elevational view of FIG. 7.
Figure 10:
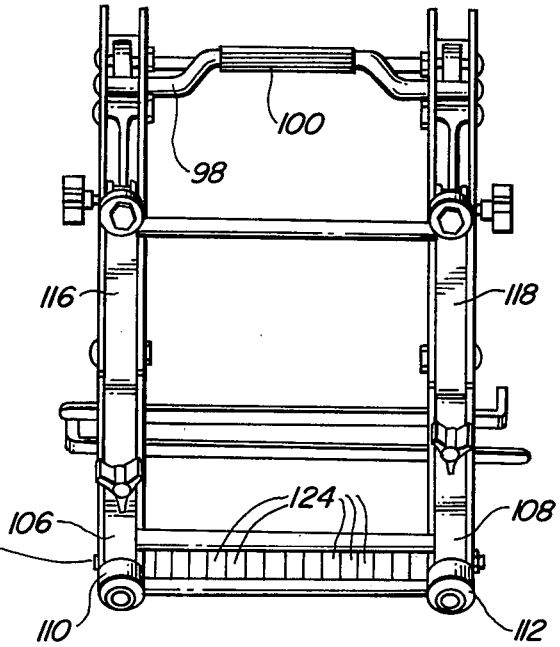
FIG. 10 is a rear elevational view of FIG. 7.
Figure 12:
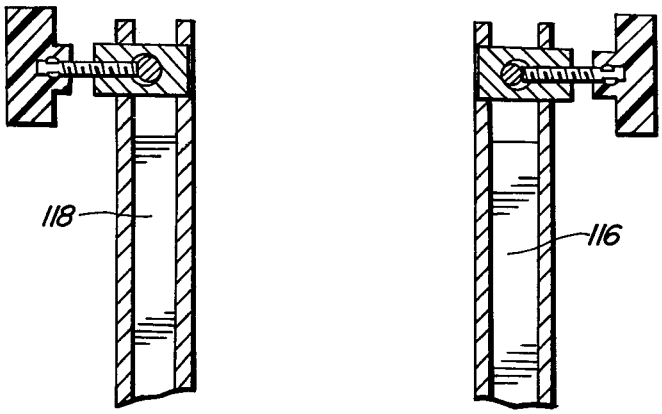
FIG. 12 is a cross-sectional view taken on the lines 12—12 of FIG. 8.
Figure 11:
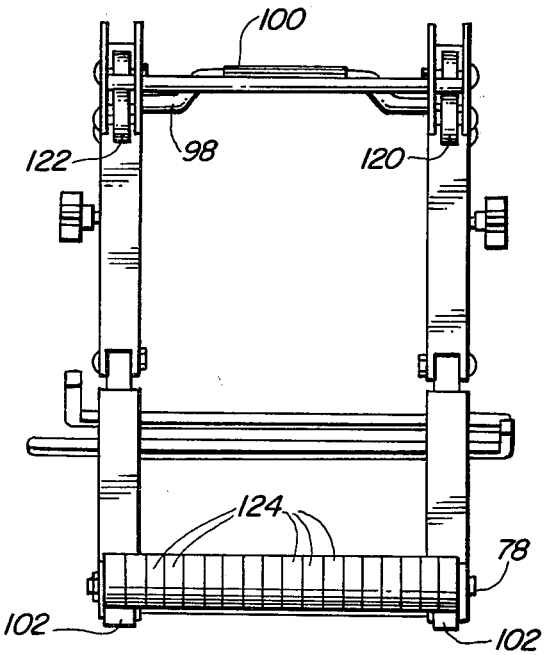
FIG. 11 is a front elevational view of FIG. 7.

Now the sheet may be pulled out of the roll from the bottom as noted in FIG. 2, and thus the roll of aluminum sheeting is always kept clean from grass and debris stains.

In the modification of FIGS. 7 to 12, the same numerals will be used to describe the same parts as in the preferred embodiment.

The difference between the modified construction and the preferred construction is that the rod 98 extending between and fixed to the channels 30, 32 has an offset therein to form a handle 100 for carrying the unit from place to place with ease.

Also, the modification is provided with pads 102, 104 adjacent the forward free end of the channels 20, 22 and on the lower ends thereof.

Also, a pair of legs 106, 108 extend outwardly angularly from attachment to the side legs 34, 36 of the concave channels 20, 22, where they are affixed. The lower ends of the legs 106, 108 are provided with rubber caps 110, 112 and the legs are held in spaced relationship by rod 114 to which the legs are affixed at the ends thereof.

Also, instead of one bracket 58, a pair of brackets 116, 118 are employed herein one for each convex channel 30, 32. The structure for both is the same as the single bracket and attachments in the preferred embodiment.

Also, rollers 120, 122 are rotatively fixed to the free ends of the side legs 29, 31 of the convex channels 30, 32.

The roller 76 comprises a multiple series of small rollers 124 affixed on a shaft.

Although but two specific embodiments of this invention are herein shown and described, it will be understood that details of the construction shown may be altered or omitted without departing from the spirit of the invention as defined by the following claims.

I claim:

1. In a device of the class described comprising:

(a) a pair of stationary, concaved, inverted U-shaped channels fixedly secured together in spaced relationship;

(b) a pair of elongated, convexly shaped, U-shaped channels pivotally affixed one to each of said concave channels at one end thereof and secured in spaced relationship;

(c) an upwardly extending bracket positioned medially between said channels;

(d) adjusting means cooperating with said bracket for fixedly securing said convex channels in variable position relative to said concave channels; and (e) shiftable means on said concave channels to secure a roll of aluminum sheeting in said device to prevent lateral movement of said roll.

2. The device according to claim 1 wherein said bracket is provided with a rotary clamp at its upper end and contains an aperture therethrough to receive said adjusting means and means to latch said adjusting means.

3. The device according to claim 1 wherein a pair of brackets extend upwardly and rearwardly one on each of said concave channels, said brackets fixed to the lower rear portions of said concave channels, and means on said brackets adjacent the free ends thereof fixedly securing said convex channels in variable positions relative to said concave channels.

4. In a device of the class described comprising:

(a) a framework having a pair of horizontal members fixed together in spaced relationship;

(b) a pair of short, stationary, concave, inverted U-shaped channels fixedly secured one to each of said members at one end thereof, spacer rods fixedly secured to and between said concave channels, said rods fixedly secured to and between said concave channels adjacent said one end;

(c) a pair of elongated, convex, U-shaped spaced channels pivoted one to each of the concave channels;

(d) an upstanding bracket anchored at one end to said spacer rods medially between said concave channels;

(e) adjusting means between one of said spacer rods and said bracket for fixedly securing said convex channels in variable positions relative to said concave channels; and (f) shiftable means on said concave channels to secure a roll of aluminum sheeting in said device to prevent lateral movement of said roll.

* * * * *